US007260973B1

(12) United States Patent
Peden

(10) Patent No.: US 7,260,973 B1
(45) Date of Patent: Aug. 28, 2007

(54) METHOD AND APPARATUS FOR REPAIRING A DAMAGED PROPELLER BLADE

(76) Inventor: Hoyt Peden, 2080 Paul Edmonson Dr., Iuka, MS (US) 38852

( * ) Notice: Subject to any disclaimer, the term of this patent is extended or adjusted under 35 U.S.C. 154(b) by 204 days.

(21) Appl. No.: 10/932,619

(22) Filed: Sep. 2, 2004

Related U.S. Application Data

(60) Provisional application No. 60/502,999, filed on Sep. 15, 2003.

(51) Int. Cl.
*B23P 15/04* (2006.01)
*B21D 5/01* (2006.01)

(52) U.S. Cl. ..... 72/384; 72/389.4; 72/447; 72/455; 72/311; 29/889.1; 29/889.6

(58) Field of Classification Search ..... 72/311, 72/389.4, 389.6, 390.6, 384, 447, 455; 29/889.1, 29/889.6
See application file for complete search history.

(56) References Cited

U.S. PATENT DOCUMENTS 2,013,705 A 9/1935 Warren
2,393,317 A 1/1946 Edwards, Jr. et al.
2,742,947 A * 4/1956 Dobbs ..... 72/316
3,032,092 A 5/1962 Erlbacher
4,058,880 A 11/1977 Hughey
4,222,259 A 9/1980 Junes
5,315,856 A 5/1994 Mackey
5,377,521 A 1/1995 Mackey
5,713,233 A 2/1998 McCarthy et al.

* cited by examiner

*Primary Examiner*—David Jones
(74) *Attorney, Agent, or Firm*—Garvey, Smith, Nehrbass & Nehrbass, L.L.C.; Charles C. Garvey, Jr.

(57) ABSTRACT

A propeller straightening apparatus utilizes a pair of adjustable hydraulic cylinders to apply pressure to a selected propeller blade of the propeller. Adjustments can include lateral, longitudinal and tilt angle. A propeller mount holds the propeller in a fixed position during straightening. The mount can be quickly loosened so that the propeller can be rotated to present a different propeller blade to the hydraulic cylinders. The cylinders have polyurethane tips portions that help grip the surface of the propeller. The apparatus can bend a selected propeller blade to change rake and/or pitch.

18 Claims, 8 Drawing Sheets

METHOD AND APPARATUS FOR REPAIRING A DAMAGED PROPELLER BLADE

CROSS-REFERENCE TO RELATED APPLICATIONS

Priority of U.S. Provisional Patent Application Ser. No. 60/502,999, filed Sep. 15, 2003, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus for straightening a bladed propeller that employs a pair of independently adjustable blade bending units, each preferably a hydraulically operated cylinder and pushrod device that enable pressure to be applied to a pair of spaced apart positions on a propeller, enabling either pitch and/or rake adjustments to be made to the propeller by simultaneously extending the spaced apart pushrods as they engage a selected one of the propeller blades.

2. General Background of the Invention

For many years, propellers have been manually straightened using a very large hammer with a plastic, polymeric or rubber head. Such hammers are commercially available from McDurmon Distributing of Fenton, Mich. Another example of such a hammer is sold by Garland Hammers (Garland Manufacturing Company) of Saco, Me.

Such a manual bending of a propeller in order to straighten it is both time consuming and imprecise. The present provides an improved method and apparatus for straightening propellers that enables precise bending of the propeller blades to achieve a desired change in rake and/or pitch.

Some propeller straightening devices have been patented. The following table lists examples of propeller repair patents.

TABLE

| Pat. No. | Title | Issue Date |
|---|---|---|
| 2,013,705 | Process for Shaping Helical Bodies and Means for Carrying out Said Process | Sep. 10, 1935 |
| 2,393,317 | Straightening Press for Aircraft Propellers and the Like | Jan. 22, 1946 |
| 3,032,092 | Propeller Straightening Apparatus | May 1, 1962 |
| 4,058,880 | Propeller Making Apparatus and Method | Nov. 22, 1977 |
| 4,222,259 | Propeller Reconditioner | Sep. 17, 1980 |
| 5,315,856 | Apparatus for Propeller Straightening | May 31, 1994 |
| 5,377,521 | Method for Propeller Straightening | Jan. 3, 1995 |
| 5,713,233 | Vane Adjustment Machine | Feb. 3, 1998 |

BRIEF SUMMARY OF THE INVENTION

The present invention provides an apparatus for straightening a dented or bent or otherwise mis-shapen propeller. The apparatus includes a frame that has an upper section and a lower section. The upper section can tilt upon the lower section.

There are a pair of hydraulic rams carried by the frame.

A hydraulic power unit can be provided to operate the rams. A propeller mount is supported upon the frame for holding the propeller to be straightened.

A plurality of adjustment mechanisms are provided for moving each ram independently of the other, the adjustment mechanisms including at least one lateral adjuster at least one longitudinal adjuster, and a tilt adjustment that tilts the upper section into a desired inclined position relative to the lower section.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
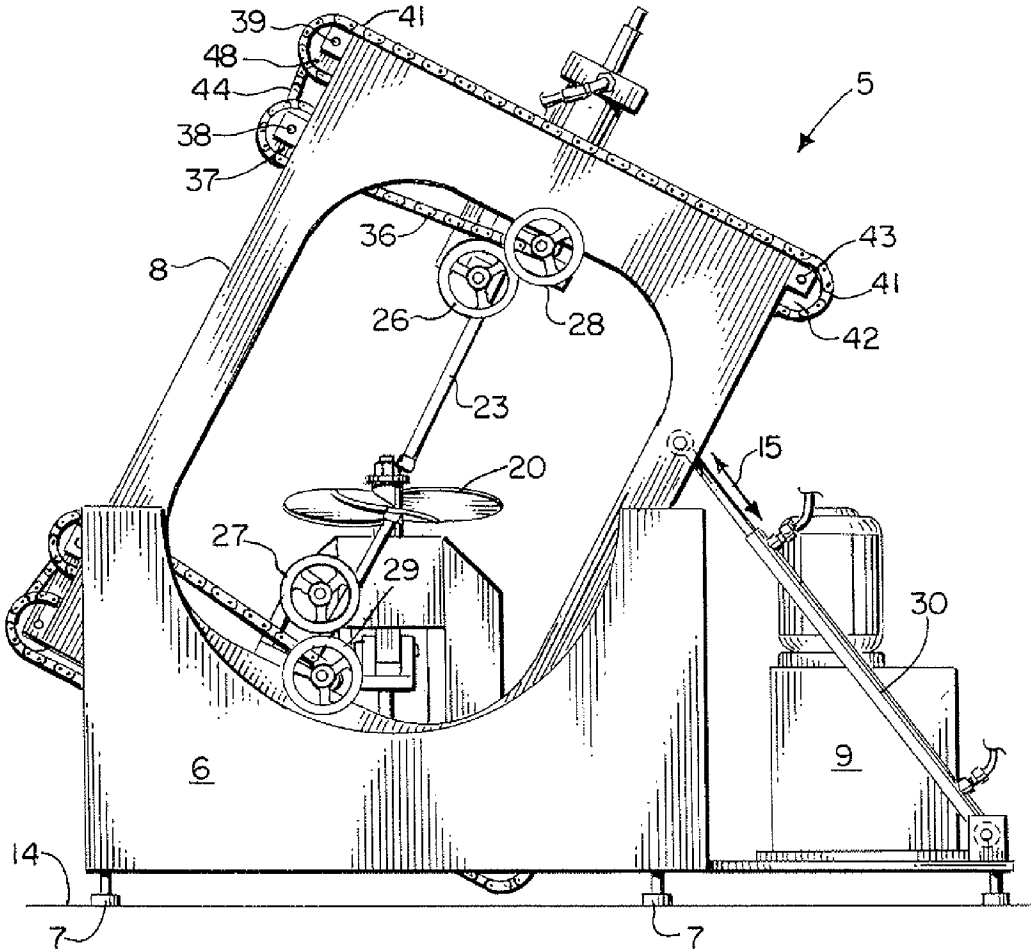
FIG. 1 is an elevation view of the preferred embodiment of the apparatus of the present invention.
Figure 2:
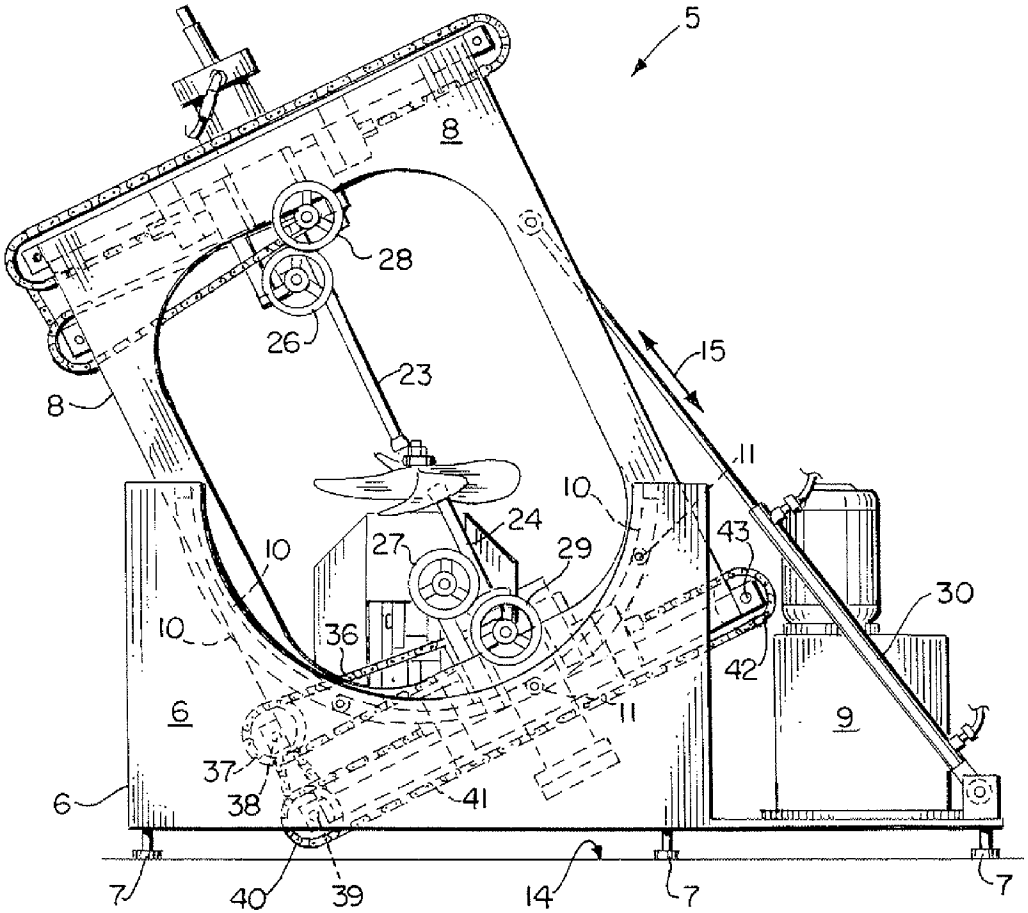
FIG. 2 is another elevation view of the preferred embodiment of the apparatus of the present invention.
Figure 3:
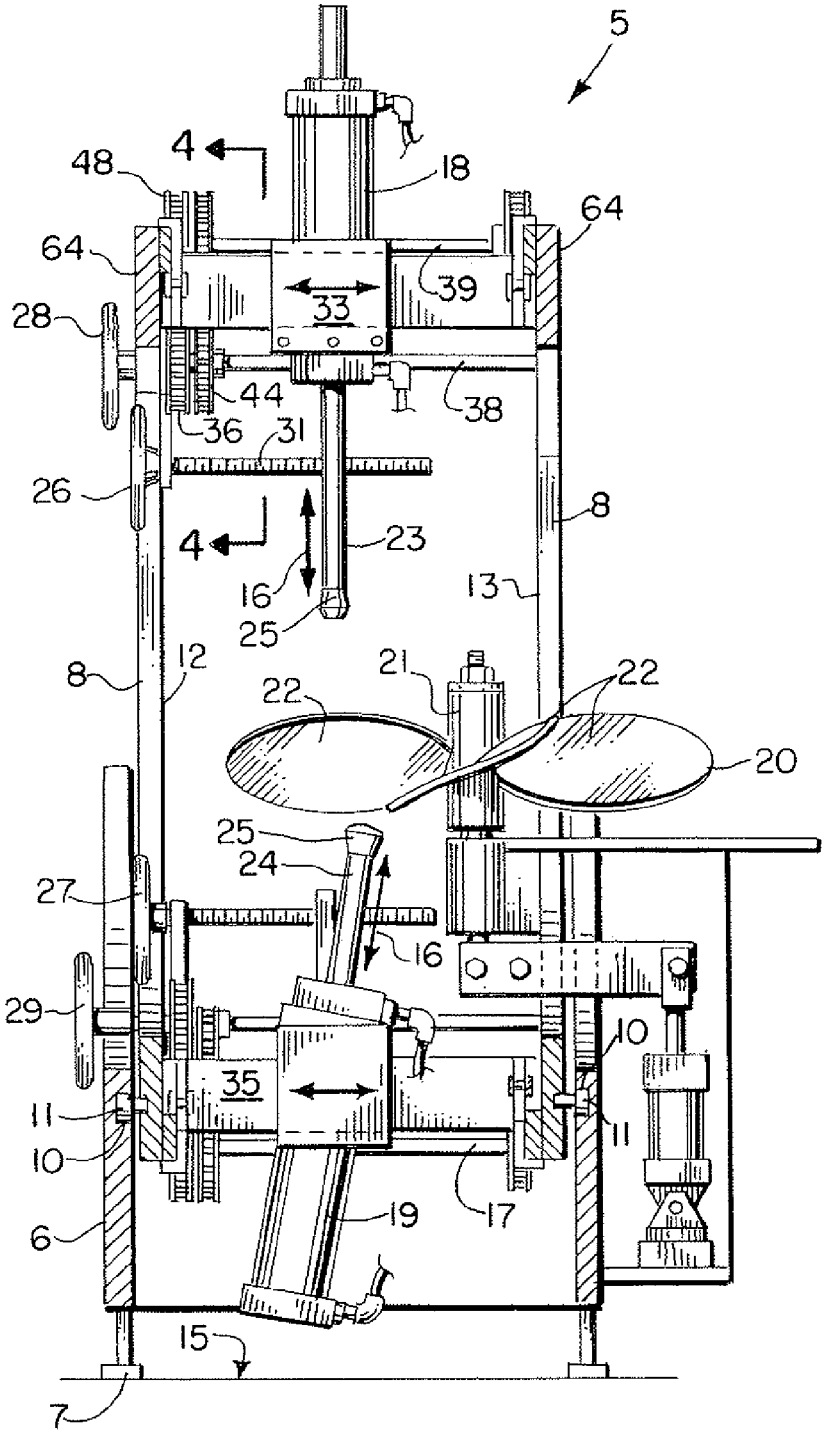
FIG. 3 is an end view of the preferred embodiment of the apparatus of the present invention.
Figure 4:
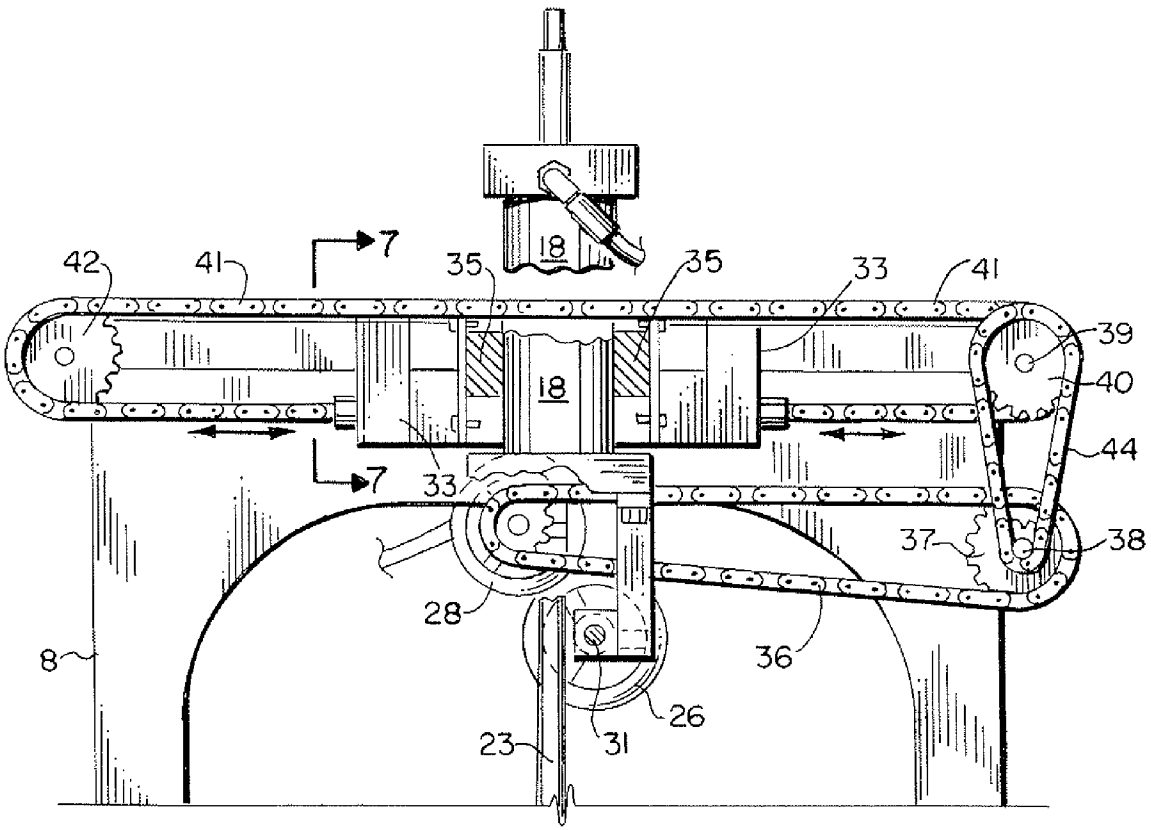
FIG. 4 is a partial elevation, partial sectional view of the preferred embodiment of the apparatus of the present invention.

FIGS. 1–3 show generally the preferred embodiment of the apparatus of the present invention designated jointly by the numeral 5. Propeller blade repairing apparatus 5 has a base 6 that is fixed, supported by an underlying floor 14 such as a concrete shop floor 14 with a plurality of feet 7 that can be adjustable with respect to the base. In this fashion, the feet 7 can be used to level the base 6.

Base 6 supports a moving frame 8 that can be tilted to a selected angle. Moving frame 8 can be mounted upon arc shape tracks 10 that are provided on base 6. A plurality of rollers 11 can engage each track 10 and thus be used to interface between moving frame 8 and base 6.

Hydraulic power unit 9 (see FIG. 14) is commercially available and can be a "V-Pak" manufactured by Parker Hannifin Corporation, Parker Hydraulics Group (www- .parker.com). Such a power unit 9 is self-contained, and typically includes a hydraulic pump, electric motor, valving, and a pressure control.

Figure 6A:
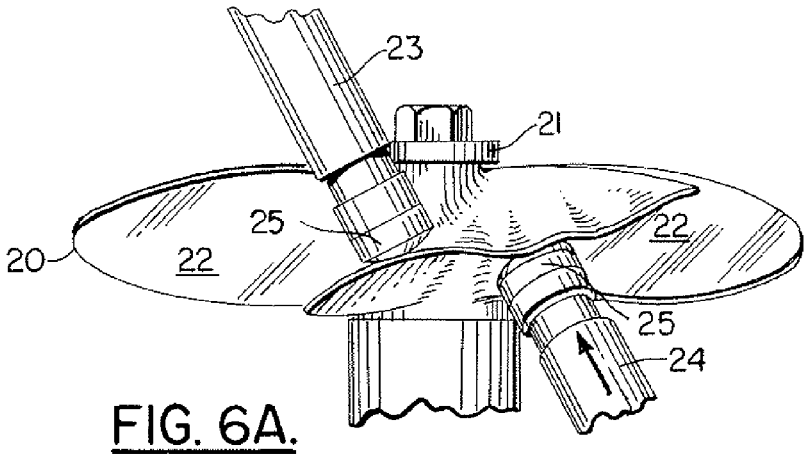
FIGS. 6A, 6B, 6C are partial perspective views of the preferred embodiment of the apparatus of the present invention illustrating the straightening of a mis-shapen propeller blade.
Figure 6B:
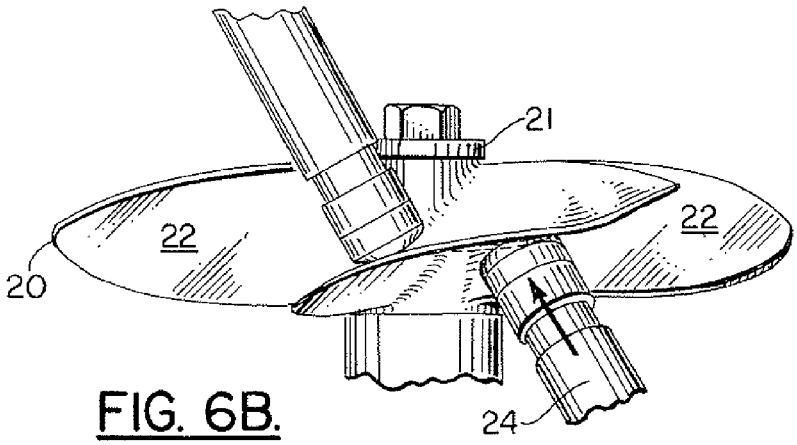
Figure 6C:
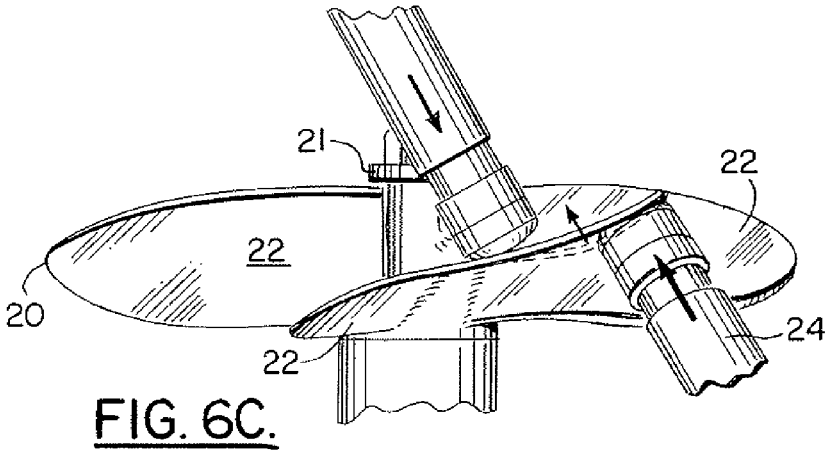

Moving frame 8 can include a pair of side panels 12 and 13 connected by a plurality of transverse beams 17. Moving frame 8 supports an upper hydraulic cylinder 18 and a lower hydraulic cylinder 19. Each hydraulic cylinder 18, 19 has a pushrod that can be used to straighten or otherwise repair the individual damaged blades 22 mounted upon hub 21 of propeller 20 (see FIGS. 6A, 6B, 6C). Upper hydraulic cylinder 18 has upper pushrod 23. Lower hydraulic cylinder 19 has lower pushrod 24. Each pushrod 23, 24 can be provided with a cushioned (e.g. polymeric) end portion 25. End portion 25 can be removable from its pushrod 23 or 24 for easy servicing or replacement. Arrows 16 in FIG. 3 schematically illustrate extension/retraction of pushrods 23, 24.

The apparatus 5 of the present invention can be adjusted to change the position of each pushrod 23, 24 (laterally, longitudinally and/or the angle of inclination) relative to a bent or damaged propeller blade 22 that is to be repaired or straightened. Upper cylinder lateral adjustment wheel 26 can be used to move the upper hydraulic cylinder 18 laterally with respect to propeller 20. Similarly, lower cylinder lateral adjustment wheel 27 can be used to move the lower hydraulic cylinder 19 in a lateral direction with respect to propeller 20. Basically, each of the upper and lower hydraulic cylinders 18, 19 can be moved to any position in between side panels 12, 13 of moving frame 8.

Each hydraulic cylinder 18 can be adjusted longitudinally with respect to propeller 20. Upper cylinder longitudinal adjustment wheel 28 can be used to move the upper hydraulic cylinder 18 in a fore and aft direction with respect to base 11. Similarly, lower cylinder longitudinal adjustment wheel 29 can be used to move the lower hydraulic cylinder 19 in a fore and aft direction. The longitudinal adjustment wheels 28, 29 can be used to move the hydraulic cylinders 18, 19 toward or away from hydraulic power unit 9.

Another adjustment provided with the apparatus 10 of the present invention is a tilt adjustment. This tilt adjustment is preferably in the form of an extensible hydraulic cylinder/pushrod 30. By extending or retracting cylinder 30, the upper, moving frame 8 tilts relative to base 6 as indicated by arrow 15 in FIGS. 1 and 2. Alternatively, a turnbuckle can be used that can be used to manually adjust the tilted position of frame 8.

Figure 9:
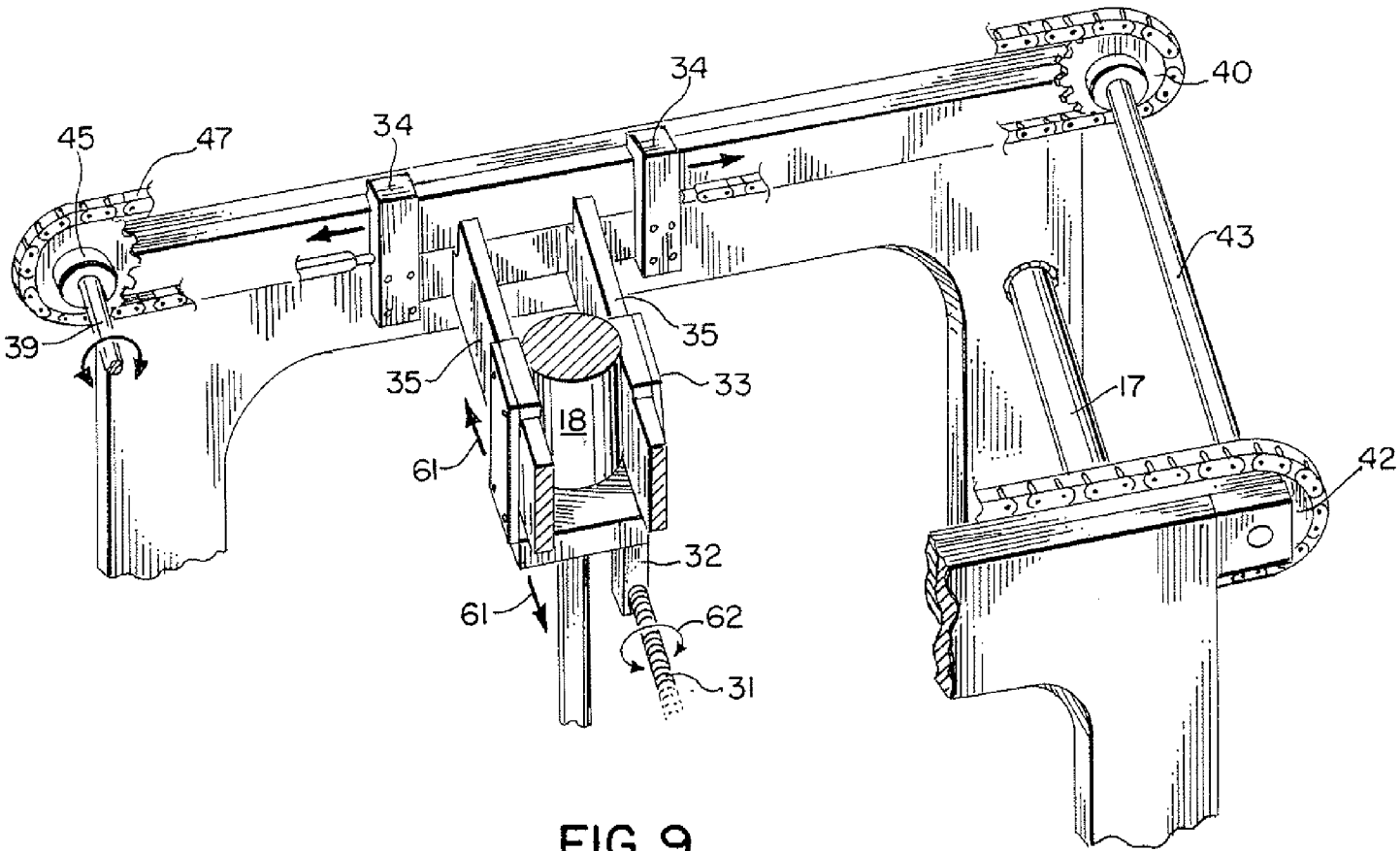
FIG. 9 is partial perspective top view taken of the preferred embodiment of the apparatus of the present invention.

The lateral adjustment wheels 26, 27 move the selected hydraulic cylinder 18 or 19 laterally by rotating a threaded shaft 31 that engages nut 32 attached to a cylinder mount 33. Each cylinder mount 33 has brass wear plates that attach to a transverse beam 35. Each cylinder mount 33 can travel side to side as indicated by arrows 61 and responsive to rotation of shaft 31 (curved arrow 62) as seen in FIG. 9. Beams 35 span between side panels 12, 13 of moving frame 8, connecting to longitudinal bearings 34 (see FIG. 9). Bearings 34 travel upon rails 64 at the upper end of side panels 12, 13.

Figure 7:
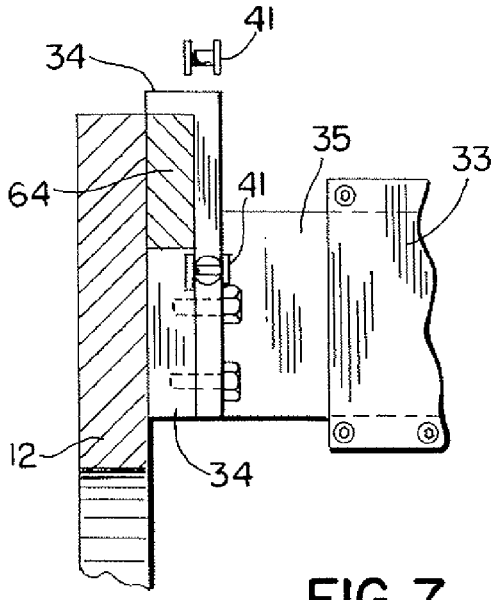
FIG. 7 is a fragmentary view of the preferred embodiment of the apparatus of the present invention.
Figure 8:
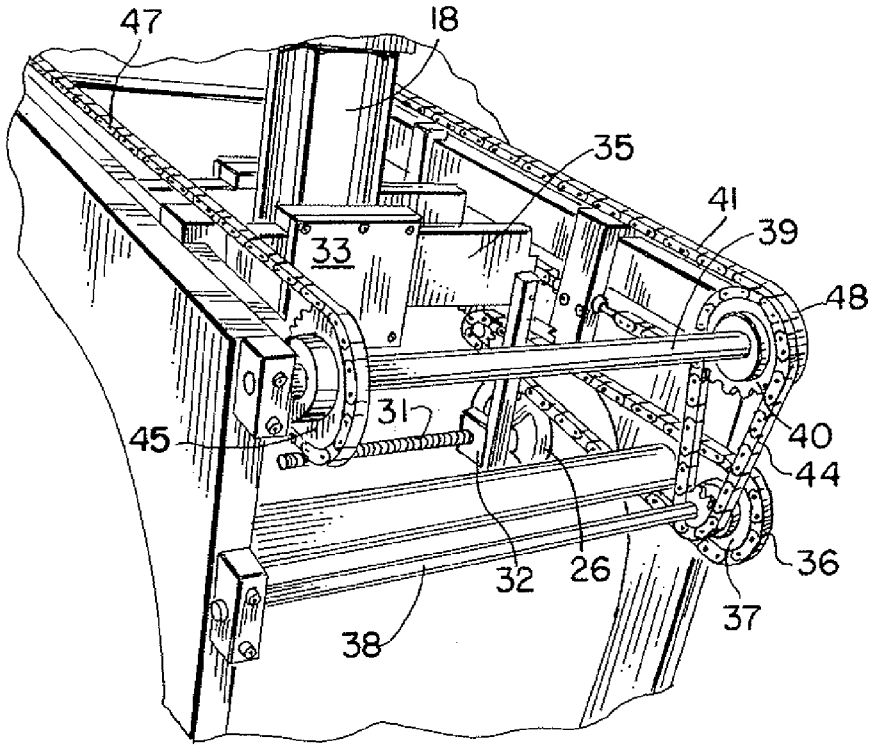
FIG. 8 is a partial perspective view of the preferred embodiment of the apparatus of the present invention.

For longitudinal adjustment, wheel operated chains are provided as shown in FIGS. 1, 3, 4 and 9. For the upper hydraulic cylinder 18 (see FIGS. 4, 7 and 9), upper cylinder longitudinal adjustment wheel 28 has a sprocket 63 engaging chain 36. Wheel 28 can be rotated to move endless chain 36 that engages sprockets 37, 63. Sprocket 37 rotates shaft 38.

Rotation of shaft 38 simultaneously rotates shaft 39 and sprocket 40 using chain 44. Chain 41 engages sprocket 40 and also connects to a upper hydraulic cylinder mount 33 at beams 34. Chain 41 engages sprocket 42 that is at the front end of the machine next to the v-pak hydraulic power unit 9 as shown in FIG. 2. Sprocket 42 is rotated by chain 41 and upper cylinder longitudinal adjustment wheel 28. Sprocket 42 rotates shaft 43. Endless chain 44 engages sprockets 37 and 40. Rotation of sprocket 48 rotates sprocket 42 and shaft 43. Endless chain 43 spans between sprocket 40 and sprocket 42.

Shaft 39 is attached to and rotates with sprockets 40 and 45. A similar if not identical adjustment mechanism can be used for transverse longitudinal adjustment of the lower hydraulic cylinder 19 as was shown and described for the upper hydraulic cylinder 18.

Figure 5A:
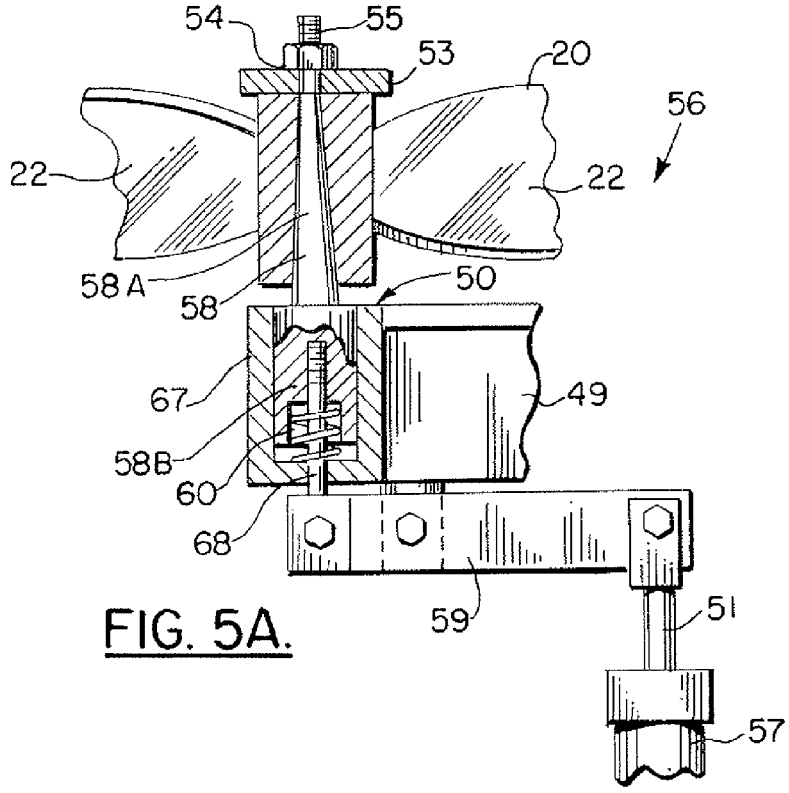
FIGS. 5A–5B are partial sectional, elevation views of the preferred embodiment of the apparatus of the present invention illustrating the propeller holder.
Figure 5B:
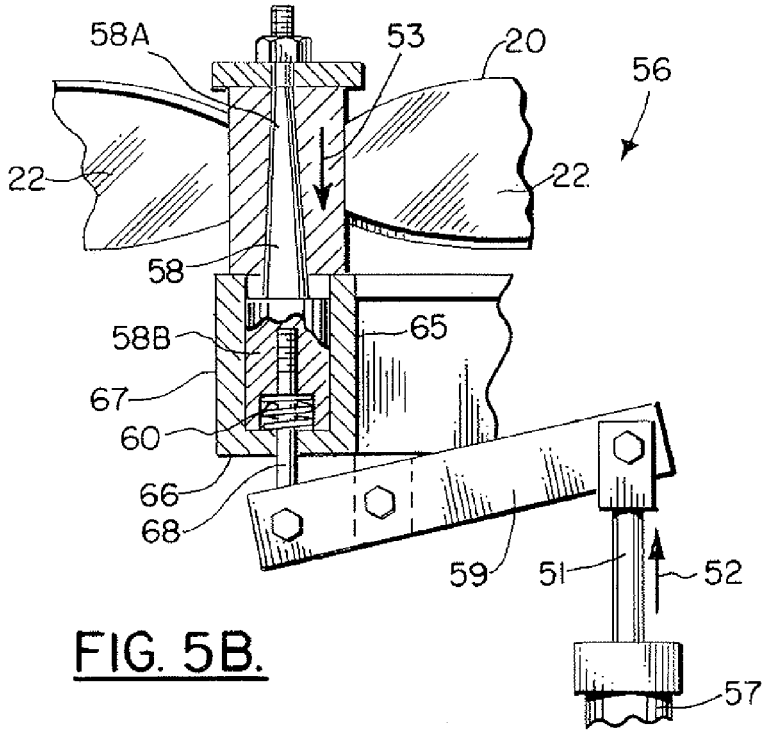

FIGS. 5A, 5B show the propeller support portion of the apparatus 5 of the present invention. The propeller support 56 provides a shaft 58 having tapered section 58A and generally cylindrically shaped section 58B. Rod 68 extends between cylindrically shaped section 58 and linkage 59. The propeller 20 can be mounted to section 58A (e.g. bolted) as shown in FIGS. 5A, 5B. Hydraulic cylinder 57 can be actuated using a hydraulic control valve. Typically, the shaft 58 is spring loaded with spring 60 to assume an upper, free spin position that enables rotation of shaft 58 and propeller 20 so that a selected blade can be positioned for repair and/or straightening. A rotary connection can be provided at the connection of rod 68 to linkage 59. If a user wants to lock the propeller, the cylinder 57 is actuated so that pushrod 51 pulls the shaft 58 downwardly (arrow 53) using linkage 59 and overcoming spring pressure. This action bottoms the cylindrically shaped section 58B against bottom plate 66 of shaft support 65 so that the shaft 58 and thus propeller 20 will not rotate. The propeller 20 is thus positioned for repair and/or straightening. Propeller 20 can be removed from support 56 by removing nut 54 and washer 53 from shaft 58 threaded end portion 58.

Parts List

The following is a list of suitable parts and materials for the various elements of the preferred embodiment of the present invention.

| Part Number | Description |
|---|---|
| 5 | propeller blade repair apparatus |
| 6 | base |
| 7 | feet |
| 8 | moving frame |
| 9 | hydraulic power unit |
| 10 | track |
| 11 | roller |
| 12 | side panel |
| 13 | side panel |
| 14 | floor |
| 15 | arrow |
| 16 | arrow |
| 17 | transverse beam |
| 18 | upper hydraulic cylinder |
| 19 | lower hydraulic cylinder |
| 20 | propeller |
| 21 | hub |
| 22 | blade |
| 23 | upper pushrod |
| 24 | lower pushrod |
| 25 | cushioned end portion |
| 26 | upper cylinder lateral adjustment wheel |
| 27 | lower cylinder lateral adjustment wheel |

-continued

| Part Number | Description |
|---|---|
| 28 | upper cylinder longitudinal adjustment wheel |
| 29 | lower cylinder longitudinal adjustment wheel |
| 30 | tilt adjustment rod |
| 31 | threaded shaft |
| 32 | nut |
| 33 | cylinder mount |
| 34 | bearing |
| 35 | transverse beam |
| 36 | endless chain |
| 37 | sprocket |
| 38 | shaft |
| 39 | shaft |
| 40 | sprocket |
| 41 | chain |
| 42 | sprocket |
| 43 | shaft |
| 44 | endless chain |
| 45 | sprocket |
| 46 | shaft |
| 47 | endless chain |
| 48 | sprocket |
| 49 | table |
| 50 | surface |
| 51 | pushrod |
| 52 | arrow |
| 53 | washer |
| 54 | nut |
| 55 | threaded end portion |
| 56 | propeller support |
| 57 | hydraulic cylinder |
| 58 | tapered shaft |
| 58A | tapered section |
| 58B | cylindrical section |
| 59 | linkage |
| 60 | spring |
| 61 | arrow |
| 62 | curved arrow |
| 63 | sprocket |
| 64 | rail |
| 65 | shaft support |
| 66 | bottom plate |
| 67 | side wall |
| 68 | rod |

The foregoing embodiments are presented by way of example only; the scope of the present invention is to be limited only by the following claims.

The invention claimed is:

1. An apparatus for straightening a bent propeller, comprising:

a) a frame that includes upper and lower sections, the upper section tilting upon the lower section;

b) a pair of hydraulic rams carried by the frame;

c) a hydraulic power unit for operating the rams;

d) a propeller mount for holding the propeller to be straightened;

e) a plurality of adjustment mechanisms for moving each ram independently of the other, said adjustment mechanisms including at least one lateral adjustment, at least one longitudinal adjustment and a tilt adjustment that tilts the upper section into a desired inclined position relative to the lower section.

2. The apparatus of claim 1 wherein each ram is provided with a lateral adjustment.

3. The apparatus of claim 1 wherein each ram is provided with a longitudinal adjustment.

4. The apparatus of claim 1 wherein the propeller mount has fixed and loosened positions that enable the propeller to be rotated in the loosened position and that disallows rotation in the fixed position.

5. The apparatus of claim 1 wherein the propeller mount is hydraulically operated.

6. The apparatus of claim 1 wherein the propeller mount is hydraulically operated by the hydraulic power unit that operates the rams.

7. The apparatus of claim 1 wherein each ram is provided with a plastic tip portion that engages the propeller during straightening.

8. The apparatus of claim 1 wherein each ram is provided with a polymeric tip portion that engages the propeller during straightening.

9. The apparatus of claim 1 wherein each ram is provided with a polyurethane tip portion that engages the propeller during straightening.

10. The apparatus of claim 1 wherein each ram is provided with a polymeric tip portion that engages the propeller during straightening.

11. The apparatus of claim 1 wherein each ram is provided with a polyurethane tip portion that engages the propeller during straightening.

12. An apparatus for straightening a bent propeller, comprising:

a) a frame that includes upper and lower sections, the upper section tilting upon the lower section;

b) a pair of hydraulic cylinders, each cylinder having a pushrod;

c) a hydraulic power unit for operating the cylinders;

d) a propeller mount for holding the propeller to be straightened;

e) a plurality of adjustment mechanisms for moving each pushrod independently of the other, said adjustment mechanisms including at least one lateral adjustment, at least one longitudinal adjustment and a tilt adjustment that tilts the upper section into a desired inclined position relative to the lower section;

f) each pushrod having a tip that is softer than the majority of the pushrod.

13. The apparatus of claim 12 wherein each cylinder is provided with a lateral adjustment.

14. The apparatus of claim 12 wherein each cylinder is provided with a longitudinal adjustment.

15. The apparatus of claim 12 wherein the propeller mount has fixed and loosened positions that enable the propeller to be rotated in the loosened position and that disallows rotation in the fixed position.

16. The apparatus of claim 12 wherein the propeller mount is hydraulically operated.

17. The apparatus of claim 12 wherein the propeller mount is hydraulically operated by the hydraulic power unit that operates the cylinders.

18. The apparatus of claim 12 wherein each cylinder is provided with a plastic tip portion that engages the propeller during straightening.

* * * * *